US006026986A

United States Patent [19]

Choi et al.

[11] Patent Number: 6,026,986

[45] Date of Patent: Feb. 22, 2000

[54] CHEMICAL SPRAY SYSTEM AND WASTE LIQUID TANK USED IN SAME

[75] Inventors: Dug-kyu Choi; Bong-seuk Park; Soon-jong Park, all of Kyungki-do, Rep. of Korea

[73] Assignee: Samsung Electronics Co., Ltd,, Suwon, Rep. of Korea

[21] Appl. No.: 09/167,528

[22] Filed: Oct. 7, 1998

[30] Foreign Application Priority Data

Dec. 8, 1997 [KR] Rep. of Korea ..... 97-66716

[51] Int. Cl.[7] ..... B67D 1/08

[52] U.S. Cl. ..... 222/64; 222/108; 222/148; 137/240; 239/112

[58] Field of Search ..... 222/64, 108, 148; 137/240; 239/112, 113

[56] References Cited

U.S. PATENT DOCUMENTS 4,465,210 8/1984 Iwanami ..... 222/148
4,792,092 12/1988 Elberson et al. ..... 239/112
5,526,841 6/1996 Detsch et al. ..... 222/148
5,601,127 2/1997 Hanson ..... 222/148
5,810,059 9/1998 Rutter et al. ..... 222/148
5,938,120 8/1999 Martin et al. ..... 239/113

*Primary Examiner*—Joseph A. Kaufman
*Attorney, Agent, or Firm*—Jones Volentine, LLP

[57] ABSTRACT

A chemical spray system includes a nozzle assembly and a suction pipe in flow communication with the nozzle assembly. A waste liquid tank is in flow communication with the suction pipe. A first valve assembly is located in a flow path of the suction pipe between the nozzle and the waste liquid tank. A generator, located in the flow path of the suction pipe between the first valve assembly and the waste liquid tank, induces fluid flow from the first valve assembly to the waste liquid tank. The nozzle assembly is suctioned via the suction pipe when the first valve assembly is in an open position. A cleansing fluid supply assembly is in flow communication with the suction pipe between the first valve assembly and the generator. Thus, a chemical can be cleaned from the generator with cleansing fluid to prevent corrosion and failure of the generator in advance.

22 Claims, 2 Drawing Sheets

CHEMICAL SPRAY SYSTEM AND WASTE LIQUID TANK USED IN SAME

BACKGROUND OF THE INVENTION

1. Field of the Invention

The present invention relates to a chemical spray system and to a waste liquid tank used in the system. More particularly, it relates to a chemical spray system for supplying a cleansing fluid to a vacuum generator for cleaning the chemical from the generator, and having a waste liquid tank for receiving a mixture of the chemical, cleansing fluid and air.

2. Description of the Related Art

FIG. 1 is a representation showing a conventional chemical spray system of a semiconductor device fabrication facility. As shown in FIG. 1, a developer is sprayed on a wafer 22, rotated by a motor 20, through a nozzle 14 connected to a developer supply tank 18 via a supply pipe 15. The sprayed developer hardens after a certain time, and then the wafer 22 is unloaded and transferred for subsequent processing.

As also shown in FIG. 1, a conventional developer spraying apparatus has an air valve 11 interposed on a suction pipe 10 and operated by a solenoid 12. The suction pipe 10 is in flow (i.e., fluid) communication with the supply pipe 15. A vacuum generator 13 is placed in flow communication with the suction pipe 10 via a sealed waste liquid tank 16. When the generator 13 is operated to evacuate air from the tank 16, the air valve 11 is opened by the solenoid 12, whereby a developer contained at the end of a nozzle 14 is subjected to suction via the suction pipe 10. The suctioned developer is thus introduced into the waste liquid tank 16. This process is controlled by a control part (not shown).

The developer collects at the outlet of the nozzle 14 after the spraying is completed, and resultant drops of the developer fall down onto the wafer 22. The excess developer can cause a malfunction in the next process. To prevent this, after the spray of the developer is completed, the generator 13 is operated, and the resultant vacuum is established in the suction pipe 10 via the sealed waste liquid tank 16 as described above. Therefore, the developer is suctioned from the outlet of the nozzle 14. In addition, developer contained in the nozzle 14 itself and 2 to 3 mm of the supply pipe 15 is suctioned into the tank 16 to prevent later hardening of the developer from clogging the nozzle 14.

Each time the above described operation is repeated, the amount of developer suctioned into the waste liquid tank 16 is increased. Therefore, a level sensor 24 is installed inside the waste liquid tank 16 for detecting the level of the developer, and if the amount of the developer reaches a certain level, the level sensor 24 is activated and an alarm is produced by the control part. An operator then discharges the waste liquid from the full tank 16.

However, the conventional waste liquid discharge scheme suffers a drawback in that the operation of the facility must be halted while the sealed waste liquid tank 16 is detached for manual discharging. In addition, since developer gases are introduced into the generator 13, the inside of the generator 13 becomes corroded, producing sintered material which often clogs the generator 13. Thus the generator malfunctions, resulting in stopping of the whole fabrication process, which in turn decreases the yield of the facility.

SUMMARY OF THE INVENTION

An object of the present invention is to provide a chemical spray system which prevents corrosion of and damage to a generator thereof.

It is another object of the invention to suction cleansing fluid into the generator to flush out chemicals such as developer.

It is another object of the invention to provide a waste liquid tank that can collect the mixture of chemical, cleansing fluid and air produced within the chemical spray system of the present invention.

It is another object of the present invention to provide a waste liquid tank that can be discharged without being detached.

To achieve these and other advantages in accordance with the purpose of the present invention, a chemical spray system includes a nozzle assembly and a suction pipe in flow communication with the nozzle assembly. A waste liquid tank is in flow communication with the suction pipe. A first valve assembly is located in a flow path of the suction pipe between the nozzle and the waste liquid tank. A generator, located in the flow path of the suction pipe between the first valve assembly and the waste liquid tank, induces fluid flow from the first valve assembly to the waste liquid tank. The nozzle assembly is suctioned via the suction pipe when the first valve assembly is in an open position. A cleansing fluid supply assembly is in flow communication with the suction pipe between the first valve assembly and the generator.

In another aspect of the invention, a cleansing fluid control circuit provides a supply signal to the cleansing fluid supply assembly in response to an opening of the first valve assembly. The cleansing fluid supply assembly is responsive to the supply signal to supply cleansing fluid into the suction pipe.

In another aspect of the invention, a waste liquid tank, for use in a chemical spray system having a vacuum generator located in a flow path of a suction pipe, includes a vessel having an interior. The tank includes an input port connected to the suction pipe and in flow communication with the generator. The input port receives a chemical, cleansing fluid, and air into the interior of the vessel. An air discharge port discharges the air from the interior of the vessel. A liquid discharge port discharges a waste liquid including the chemical and the cleansing fluid from the interior of the vessel.

The chemical spray system and the waste liquid tank used in the same, substantially obviate one or more of the problems due to the limitations and the disadvantages of the related art.

DETAILED DESCRIPTION OF THE PREFERRED EMBODIMENTS

Reference will now be made in detail to the preferred embodiments of the present invention, examples of which are illustrated in the accompanying drawings.

Figure 1:
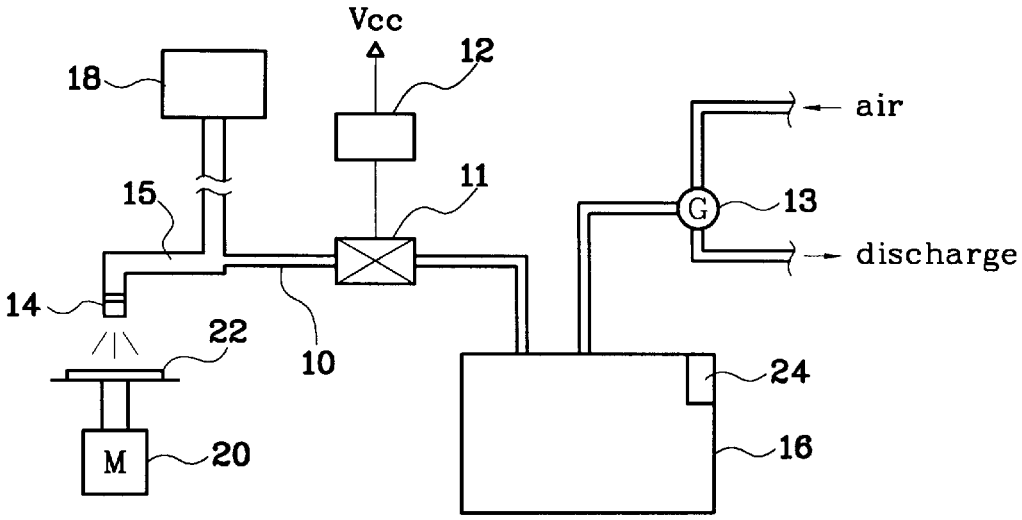
FIG. 1 (PRIOR ART)
FIG. 1 is a representation showing the conventional chemical spray system of a semiconductor device fabrication facility.
Figure 2:
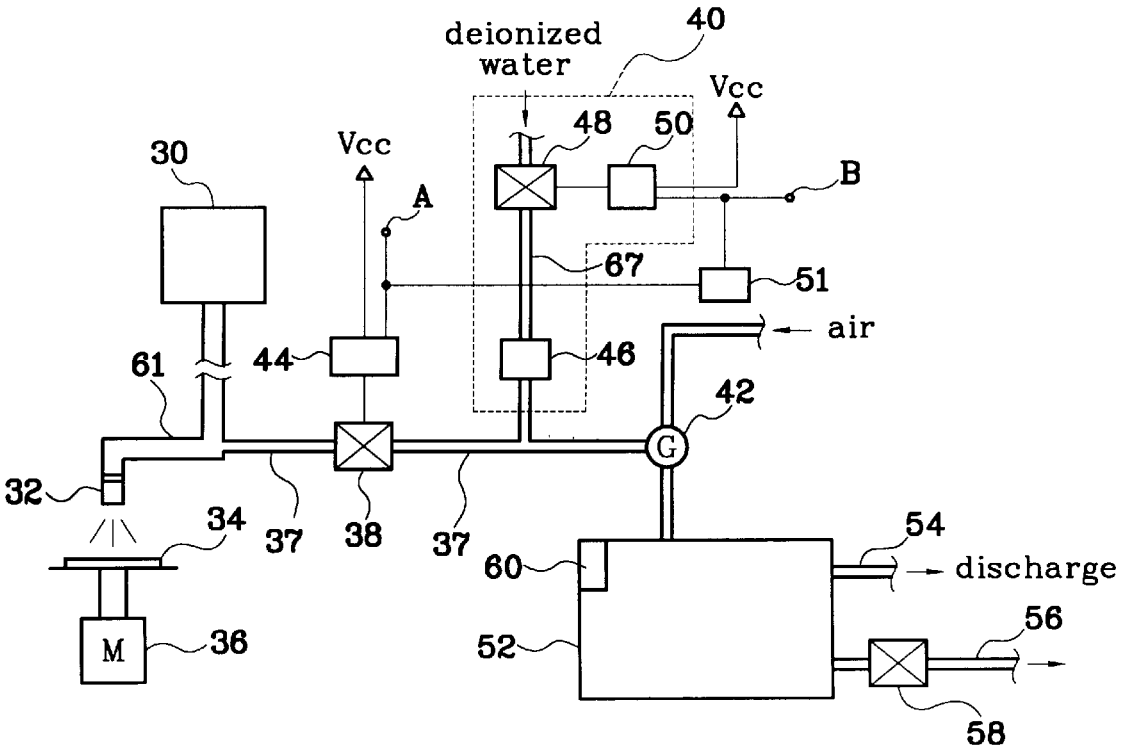
FIG. 2 is a representation showing the chemical spray system according to one embodiment of the present invention.

Referring to FIG. 2, a chemical supply tank, such as a developer supply tank 30, is connected to a nozzle 32 via a supply line 61. Spaced a short distance below the nozzle 32, a wafer 34 is mounted on a plate connected to a motor 36. One side of a first valve assembly 38, including, for example, a fluid (or air) valve for opening and closing to provide suction, is in flow communication with the supply line 61 in close proximity to the nozzle 32 via a portion of a suction pipe 37. Another side of the first valve assembly 38 is in flow communication with a deionized water supply assembly 40 via another portion of the suction pipe 37. This other side of the first valve assembly 38 is also in fluid communication with a vacuum generator 42, in parallel with the deionized water supply part 40. In the embodiment of FIG. 2, deionized water is an example of a cleansing fluid which may be used to clean or rinse the vacuum generator 42. Other suitable cleansing fluids may be used as well.

In this example, the fluid valve of the first valve assembly 38 is responsive to the opening and closing of a solenoid 44. The solenoid 44 is itself controlled by an input voltage supplied at its electronic terminal A, and is powered by a drive voltage Vcc.

The deionized water supply assembly 40, includes, for example, a deionized water supply pipe 67, a second valve assembly 48, a second solenoid 50, and a flow rate controller 46. The assembly 40 supplies deionized water to a portion of the suction pipe 37 located between the first valve assembly 38 and the vacuum generator 42. The second solenoid 50 controls opening and closing of the second valve assembly 48 in response to an input voltage supplied at its electronic terminal B. The flow rate controller 46 controls a flow rate of water into the suction pipe 37 when the second valve assembly 48 is in an open position.

A control circuit 51 is connected between the electronic terminals A, B of the solenoid 44 and the second solenoid 50, respectively. Responsive to an externally supplied input voltage to terminal A, the control circuit 51 provides a water supply signal to the B terminal to cause deionized water to be supplied for a set supply time. For example, when an electrostatic voltage at transistor-transistor logic (TTL) levels of the circuit 51 changes as a result of a voltage applied to the A terminal, a corresponding signal is provided to the B terminal of the second solenoid 50. In addition, a drive voltage Vcc is supplied to both the solenoid 44 and second solenoid 50, as well as to the control circuit 51.

A pipe for air flow is connected to one side of the generator 42, and on the other end of the generator 42, a waste liquid tank 52 is connected via the suction pipe 37. The waste liquid tank 52 includes, for example, an air discharge port (e.g. a pipe) 54 for discharging air, and a fluid discharge port (e.g. a pipe) 56 for discharging waste liquid via a third valve assembly 58. Waste liquid includes the chemical or the deionized water or a mixture of both. In addition, inside the waste liquid tank 52, a level sensor 60 for detecting the waste liquid level is also provided.

The generator 42 of this embodiment of the present invention is operated after the developer is sprayed on a wafer. When the first valve assembly 38 is opened, a certain vacuum is formed in the suction pipe 37 so as to create a suction force toward the generator 42 from the nozzle 32. Deionized water is also introduced into the generator 42 by the suction. The suctioned developer is flushed, i.e., cleaned out of the generator 42, by the deionized water, and the mixture of developer and water is introduced into the waste liquid tank 52. The above process is controlled by a control part (not shown).

In other words, when the wafer 34 is loaded, the developer is sprayed from the developer supply tank 30 through the supply pipe 61 on the wafer 34. The developer is sprayed for a certain time, and the developer sprayed on the wafer 34 selectively dissolves an exposed photoresist layer on the wafer surface. At this time, the first valve assembly 38 is closed, and the generator 42 is not operated. The deionized water is also not supplied during this time.

After spraying of the developer is stopped, the application of suction to the nozzle 32 commences. To establish suction, the generator 42 is operated to establish air flow therethrough, thus creating a certain vacuum in the suction pipe 37. The air flow is also introduced into the waste liquid tank 52 by operation of the generator 42, and the air is discharged via the air discharge port 54.

After or during formation of the vacuum, the first valve assembly 38 is opened, for example, for one second, and the developer on the end of the nozzle 32 is drawn back into the supply pipe about 2 to 3 mm. After opening of the first valve assembly 38, the second valve assembly 48 of the deionized water supply assembly 40 is opened. Deionized water is thus supplied to the generator 42 via the suction pipe 37 to prevent contamination of the generator 42 by the developer. For example, the deionized water may be supplied for about 5 to about 15 seconds. The flow rate controller 46 changes the flow rate of the deionized water.

An embodiment of the control circuit 51 which allows the supply time of the deionized water to be varied is described with reference to FIG. 3 and FIG. 4.

Figure 3:
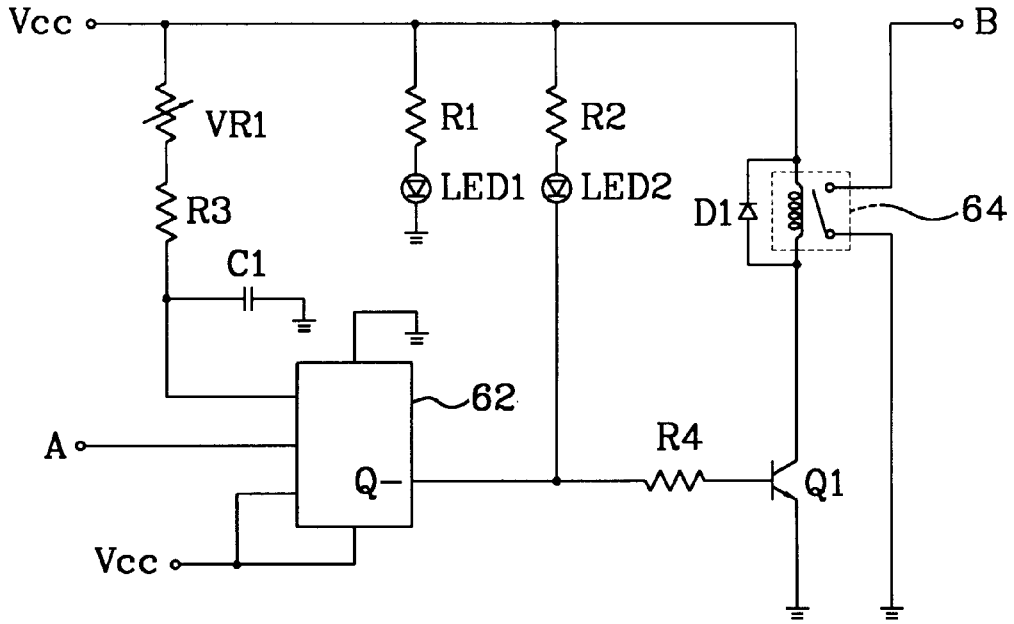
FIG. 3 is a circuit diagram of a cleansing fluid control circuit according to an embodiment of the present invention.

Referring to FIG. 3, the drive voltage (Vcc) is applied to a variable resistance (VR1), a resistance (R1), a resistance (R2), and a relay 64 which are all connected in parallel. On the branch with variable resistance (VR1), another resistance (R3) is connected in series. In addition, the variable resistance (VR1) and the resistance (R3) are connected to a condenser (C1) in parallel with a monostable multivibrator 62. The variable resistance (VR1), the resistance (R3) and the condenser (C1) define an RC time-constant of the monostable multivibrator 62. Further, a light emitting diode (LED1) is connected to the resistance (R1) and grounded.

An externally supplied voltage applied to the A terminal of the solenoid 44 is also applied to an input of the monostable multivibrator 62. The drive voltage Vcc is also supplied to the monostable multivibrator 62. An inverted output terminal (Q−) of the monostable multivibrator 62 is connected to the parallel branch including the light emitting diode (LED2) connected in series with the resistance (R2), and to a second branch including a resistance (R4) connected to the base of a transistor (Q1) in series. A collector of the transistor (Q1) is connected to a relay 64, and the emitter thereof is grounded. A diode (D1) is connected across the relay 64. One terminal of the switching terminals of the relay 64 is common with one terminal (B) of the second solenoid valve 50, and the other terminal is grounded.

Figure 4:
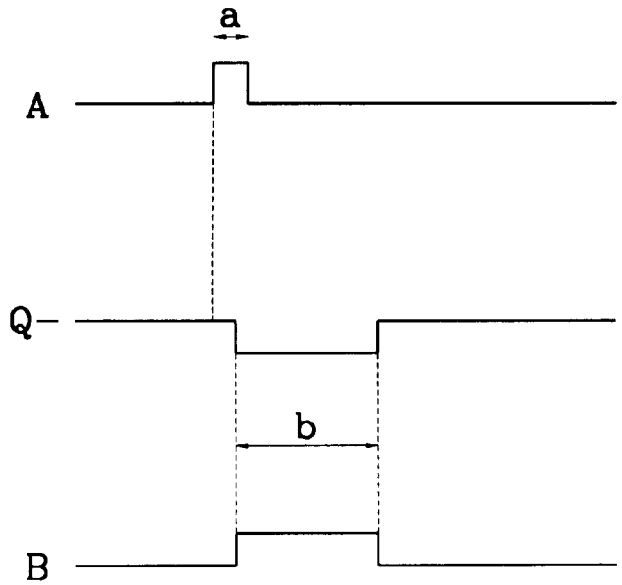
FIG. 4 is a time plot showing the signals associated with the operation of the circuit in FIG. 3.

The circuits of FIG. 3 are operated as shown by the signals of FIG. 4. When the spray of the developer is completed, a signal pulse is input to the monostable multivibrator 62 and to the solenoid 44 via the terminal A. As shown in FIG. 4, the signal pulse applied to the terminal A has a pulse interval "a", during which time the solenoid 44 is operated and the first valve assembly 38 responsive thereto is open. The pulse interval "a" may be one second, for example.

Referring still to FIG. 4, when the signal of the terminal A in the control circuit 51 is turned from low to high, the signal of the inverted output terminal (Q−) of the monostable multivibrator 62 changes from high to low after a short delay. The signal at terminal (Q1) remains low for an interval "b" which corresponds to the RC time constant set by VR1, R3 and C1. The low signal is input to the transistor (Q1) which was previously in an on-state. The transistor (Q1) is thus turned off, which turns the relay 64 off so that the terminal B is supplied with a high voltage for the same interval "b," e.g., about 10 sec. During this interval "b," the second solenoid 50 causes the second valve assembly 48 to open, and dionized water is supplied to the suction pipe 37. The generator 42 is operated during this time in which the valve assembly 48 is open and the deionized water is supplied. Noting that deionized water continues to be supplied even after the first valve assembly 38 is closed, the deionized water is made to flow into the generator 42, and thus cleans out the developer from inside the generator pipes, prior to discharge into the waste liquid tank 52.

In the circuit of FIG. 3, the supply time "b" of the deionized water supply can be adjusted by varying the variable resistance (VR1) to thereby change the RC time constant of the monostable multivibrator 62.

The red light of the light emitting diode (LED1) lights when power (i.e., voltage Vcc) is supplied to the circuit. Thus, the power supply state of the circuit can be determined. The green light (LED2) lights only when deionized water is being supplied. Though diodes are used to indicate the state of the control circuit, any display device known in the art could be used. As described above, the supply of power and deionized water can be continuously monitored, and the contamination of the generator 42 due to the developer can be prevented in advance.

Therefore, according to the present invention, the deionized water is supplied to the generator, and cleans out the chemical used in the spray so that corrosion caused by the chemical and the subsequent damage to the generator are prevented. Further, the supply of deionized water can be confirmed, e.g., by the green light of an LED, and the supply time (and thus the supply amount) for the deionized water can be controlled, e.g., by the variable resistance. The waste liquid is then easily discharged by the installation of a discharge pipe 56 in the waste liquid tank 52.

It will be apparent to those skilled in the art that various modifications and variations of the present invention can be made without departing from the spirit or scope of the invention. Thus, it is intended that the present invention cover the modifications and variations of this invention provided they come within the scope of the appended claims and their equivalents.

What is claimed is:

1. A chemical spray system comprising:

a nozzle assembly;

a suction pipe in flow communication with the nozzle assembly;

a waste liquid tank in flow communication with the suction pipe;

a first valve assembly located in a flow path of the suction pipe between the nozzle and the waste liquid tank;

a generator, located in the flow path of the suction pipe between the first valve assembly and the waste liquid tank, which induces fluid flow from the first valve assembly to the waste liquid tank, wherein the nozzle assembly is suctioned via the suction pipe when the first valve assembly is in an open position; and a cleansing fluid supply assembly in flow communication with the suction pipe between the first valve assembly and the generator.

2. The chemical spray system of claim 1, further comprising a cleansing fluid control circuit for providing, in response to an opening of said first valve assembly, a supply signal to the cleansing fluid supply assembly, wherein the cleansing fluid supply assembly is responsive to the supply signal to supply cleansing fluid into the suction pipe.

3. The chemical spray system of claim 1, wherein the generator comprises an air intake pipe, and wherein the generator draws air from the air intake pipe into the waste liquid tank to induce the fluid flow from the first valve assembly to the waste liquid tank.

4. The chemical spray system of claim 2, wherein the cleansing fluid supply assembly comprises:

a fluid pipe in flow communication with the suction pipe between the first valve assembly and the generator; and a second valve assembly located in a flow path of the fluid pipe.

5. The chemical spray system of claim 4, further comprising a flow rate controller located in a flow path of the fluid pipe between the second valve assembly and the suction pipe.

6. The chemical spray system of claim 2, wherein the supply signal begins in an on state, indicative of opening the flow of cleansing fluid, after the first valve assembly is opened, and ends the on state after a given duration.

7. The chemical spray system of claim 3, wherein the waste liquid tank comprises an air discharge port.

8. The chemical spray system of claim 7, wherein the waste liquid tank further comprises:

a fluid discharge port; and a third valve assembly for controlling a discharge flow through the fluid discharge port.

9. The chemical spray system of claim 2, wherein the first valve assembly is opened in response to an externally supplied first valve signal, and the cleansing fluid control circuit comprises:

a logic circuit which receives the first valve signal and outputs a pulse signal of a given duration in response to the first valve; and a switching device, connected to the logic circuit, which is responsive to the pulse signal to output the supply signal.

10. The chemical spray system of claim 9, wherein the logic circuit comprises a monostable multivibrator.

11. The chemical spray system of claim 9, wherein the logic circuit comprises:

a variable resistance; and a condenser connected in parallel with the variable resistance to define an RC time constant, wherein the duration of the pulse signal is set according to the RC time constant.

12. The chemical spray system of claim 9, wherein the cleansing fluid control circuit further comprises a first display device which provides a power-on display when receiving a drive voltage.

13. The chemical spray system of claim 12, wherein the cleansing fluid control circuit further comprises a second display device which provides a water supply display when receiving the pulse signal.

14. The chemical spray system of claim 9, wherein the pulse signal changes to a low voltage state when the first valve signal changes to a high voltage state.

15. The chemical spray system of claim 14, wherein cleansing fluid flows into the suction pipe when the pulse signal is in the low state, and the pulse signal remains in the low state for the given duration.

16. The chemical spray system of claim 15, wherein the given duration is in a range from about 5 seconds to about 15 seconds.

17. The chemical spray system of claim 1, wherein the cleansing fluid is deionized water.

18. The chemical spray system of claim 2, wherein the cleansing fluid is deionized water.

19. The chemical spray system of claim 3, wherein the cleansing fluid is deionized water.

20. A waste liquid tank for use in a chemical spray system having a vacuum generator located in a flow path of a suction pipe, the waste liquid tank comprising:

a vessel having an interior;

an input port connected to the suction pipe and in flow communication with the generator, said input port receiving a chemical, a cleansing fluid, and air into the interior of said vessel;

an air discharge port for discharging the air from the interior of said vessel; and a liquid discharge port for discharging a waste liquid including the chemical and the cleansing fluid from the interior of said vessel.

21. The waste liquid tank of claim 20, further comprising a discharge valve assembly connected to the liquid discharge port.

22. The waste liquid tank of claim 20, further comprising a sensor, disposed on an inner upper wall of said vessel, which senses a level of the waste liquid within the interior of said vessel.

* * * * *